US005257861A

United States Patent [19]

Domenig et al.

[11] Patent Number: 5,257,861

[45] Date of Patent: Nov. 2, 1993

[54] LATERALLY ADJUSTABLE MOUNTING BRACKET FOR USE IN A DESK CABINET DRAWER AND WITH A DRAWER GUIDE HAVING A BENT TONGUE

[75] Inventors: Georg Domenig; Rick Marsh, both of Kernersville, N.C.

[73] Assignee: Grass America, Inc., Kernersville, N.C.

[21] Appl. No.: 929,755

[22] Filed: Aug. 12, 1992

[51] Int. Cl.[5] ..... A47B 88/00

[52] U.S. Cl. ..... 312/334.5; 248/223.4; 384/22

[58] Field of Search ..... 312/334.12, 334.7, 334.21, 312/334.42, 334.5; 248/225.1, 221.4, 223.4; 384/22

[56] References Cited

U.S. PATENT DOCUMENTS

| | | | |
|---|---|---|---|
| 2,885,694 | 5/1959 | Ulm | 312/334.26 |
| 3,154,281 | 10/1964 | Frank | 248/221.4 |
| 3,675,883 | 7/1972 | Holmes et al. | 312/334.5 |
| 3,750,993 | 8/1973 | Read | 312/334.5 |
| 4,697,774 | 10/1987 | Sarton et al. | 248/225.1 |
| 4,795,116 | 1/1989 | Kohut et al. | 248/221.4 |
| 4,810,045 | 3/1989 | Lautenschläger | 312/334.5 |
| 4,930,742 | 6/1990 | Schofield et al. | 248/225.1 |
| 5,039,181 | 8/1991 | Lautenschläger | 312/334.7 |
| 5,090,787 | 2/1992 | Harley | 312/334.7 |

*Primary Examiner*—Kenneth J. Dorner
*Assistant Examiner*—Janet M. Long

[57] ABSTRACT

A laterally adjustable mounting bracket for use with a desk or cabinet drawer and with a drawer guide having a bent tongue, the bracket including a base and opposing spring flanges flexibly secured to the base and cooperatively receiving the drawer guide tongue for lateral adjustment. The base is secured to the desk or cabinet, and latching members having shaft sections and engaging ears secure the bracket to the desk or cabinet.

14 Claims, 1 Drawing Sheet

LATERALLY ADJUSTABLE MOUNTING BRACKET FOR USE IN A DESK CABINET DRAWER AND WITH A DRAWER GUIDE HAVING A BENT TONGUE

BACKGROUND OF THE INVENTION

1. Field of the Invention

The present invention relates to desk or cabinet drawer mounting brackets and more particularly, to a new and improved mounting bracket for a desk drawer guide having a bent tongue, the bracket having a base with opposing spring flanges flexibly secured to the base and cooperatively receiving the drawer bent tongue for lateral adjustment of the drawer with respect to the desk or cabinet.

2. Description of the Prior Art

Various types of mounting brackets for desk and cabinet drawers have been used in the furniture industry for many years. For the most part, these brackets are inexpensively made and hence not precisely designed or machined to ensure stability, long wear and efficient operation. For example, devices have adjustment elements formed directly in the bracket body making it difficult to adjust, quick to wear, and soon unstable. To provide longer lasting mounting brackets operable with greater efficiency and more precise adjustability, it has been determined that more refined design and engineering skills are required. The present invention addresses this need and interest.

SUMMARY OF THE INVENTION

The general purpose of the present invention, which will be described subsequently in greater detail, is to provide a new and improved adjustable mounting bracket to be used on a desk drawer having a drawer guide with a bent tongue that has all of the advantages of prior art brackets and none of the disadvantages. To attain this purpose, a representative embodiment of the present invention is illustrated in the drawings and makes use of a base and opposing spring flanges flexibly secured to the base cooperatively receiving the drawer tongue for lateral adjustment of the drawer with respect to its position within the desk or cabinet. Appropriate securing means affix the base to the desk or cabinet, and adjustable features of the base bracket and bent tongue limit the lateral movement of the drawer and carried drawer guide within an acceptable range. The spring flanges at least partially encircle a portion of the drawer guide tongue portion, and the base-securing means includes fasteners extending through the desk or cabinet back wall. The fasteners are formed with a dowel portion and flexible latching members having shaft sections and engaging ears to secure the bracket to the desk or cabinet.

Thus, there has been outlined, rather broadly, the more important features of the invention in order that the detailed description thereof may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangement of the components set forth in the following description, which are illustrated in the drawings. The invention is capable of other embodiments and of being practiced and being carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions and so far, they do not depart from the spirit and scope of the present invention.

From the foregoing summary, it is therefore apparent that an object of the present invention is to provide a new and improved adjustable mounting bracket for a desk or cabinet drawer which has all of the advantages of prior art brackets and none of the disadvantages.

It is another object of the present invention to provide a new and improved design of a more reliable and functional mounting bracket than has heretofore been available.

It is yet a further object of the present invention to provide a new and sophisticated, precision made mounting bracket that can operate reliably and efficiently and yet enable renewed preselected lateral adjustments to be made to the mounted drawer with respect to the housing desk or cabinet.

These together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings and descriptive matter in which like characters of reference designate like parts throughout the several views.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
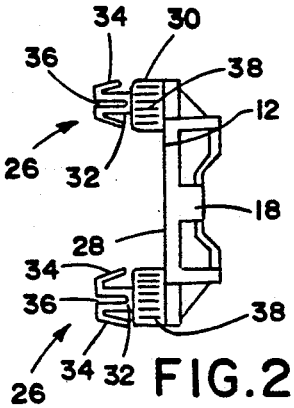
FIG. 2 is a front end elevational view of the bracket shown in FIG. 1.
Figure 1:
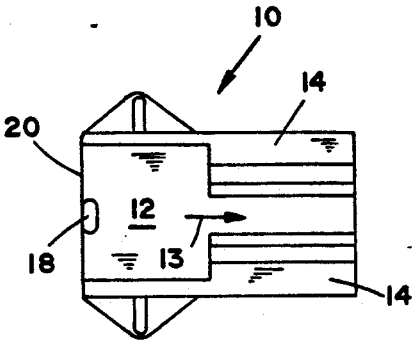
FIG. 1 is a plan view of the adjustable mounting bracket comprising the present invention.
Figure 5:
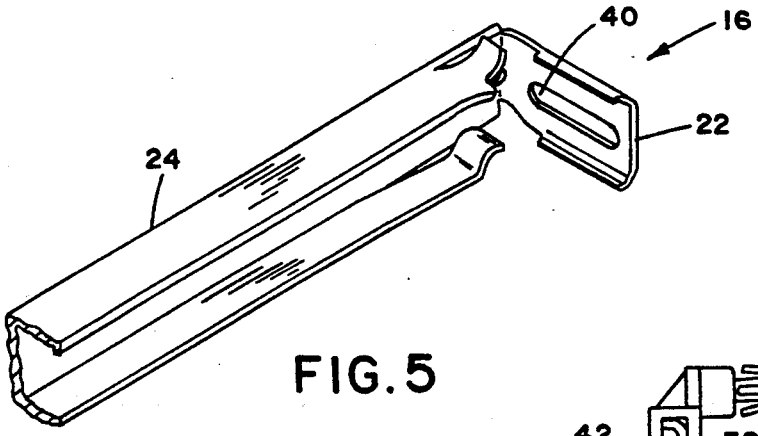
FIG. 5 is a perspective and fragmentary view of the drawer guide having a bent tongue portion that is cooperatively and adjustably affixed to the bracket illustrated in FIGS. 1, 2, 3 and 4.

With reference now to the drawings and particularly to FIG. 1, an adjustable mounting bracket shown generally as 10 has a base portion 12 and opposing spring flanges 14 flexibly secured to base 12 and configured to cooperatively receive a drawer guide bent tongue portion shown generally as 16 in FIG. 5. Tongue portion 16 is positioned against base 12 and moved (see arrow 13) into engagement under spring flanges 14. A stop 18 at the heel 20 of bracket 10 is configured to permit the introduction of the leading end 22 of tongue portion 16 and to prevent the withdrawal of tongue portion 16 during shipment of the assembled drawer guide and bracket or during lateral adjustment of an installed device.

Figure 3:
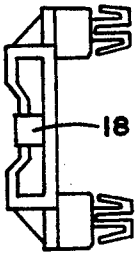
FIG. 3 is a rear end elevational view of the bracket shown in FIGS. 1 and 2.
Figure 4:
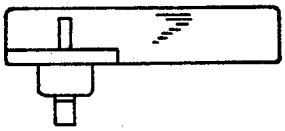
FIG. 4 is a side elevational view of the bracket shown in FIGS. 1, 2 and 3.

Opposing spring flanges 14 are designed to hold tongue portion 16 in a position against lateral movement without the exertion of a predetermined amount of lateral force on drawer guide 24. As shown in FIG. 3, the opposing spring flanges are secured to the base and each have an upstanding side section integrally secured to the base, a flat top section generally parallel to the base and connected to the side section, an inclined section extending downwardly from the top section toward the base, and a lower section generally parallel to the base connected to the inclined section forming a tongue portion opening smaller than the thickness of the tongue portion. The tongue portion openings cooperatively receive the tongue portion and frictionally maintain the tongue portion therein for lateral adjustment. In this design, a lateral force of from 6 to 8 pounds is required to laterally reposition a single mounted drawer guide. When a pair of opposing drawer guides are installed carrying a drawer weighing approximately 75 pounds (based on 15 pounds weight per square foot of drawer bottom space) a total lateral force of 12 to 16 pounds is required to laterally reposition the entire assembly.

Fasteners shown generally as 26 extend from the back wall 28 of base 12. Each of the fasteners 26 has a dowel portion 30 and flexible latching members each having grooved shaft sections 32 and drawer engaging ears 34. The size of the fasteners are designed to cooperate with the thickness of the desk or cabinet wall to which they are fastened. Thus each fastener will be of a precise length to enable it to be pushed through an aperture in the wall to which it is connected to the extent that the ears 34 expand once the fastener has been extended through the hole and thereby resist the withdrawal of the fastener from its seated position by engaging the back surface of the wall through which they are passed. Flexibility of the ears is controlled by the positioning of a slot 36 that will control the extent to which the ears can be compressed as they are moved through the aperture of the wall. It has also been found advantageous in some cases to provide one or more ribs 38 around dowel portions 30 to snugly seat the dowels in the apertures within the supporting wall.

Figure 6:
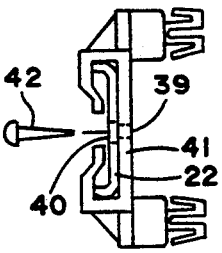
FIG. 6 is a rear end elevational view of an alternative embodiment of the bracket comprising the present invention wherein the stop has been replaced by a screw receiving aperture.

In an alternative embodiment (FIG. 6), stop 18 an be eliminated and a hole 39 can be formed in the back wall 44 of the bracket to receive a fixing screw 42 extending through such hole and through slot 40 of tongue portion leading end 22 to secure the drawer guide 24 against further movement.

It has been found that the device forming the present invention is economical to construct in that it can be provided in a one-piece construction. The bracket is designed primarily for use with a double captive drawer guide system which includes a drawer guide having a top flange which curves around the top of the roller of the drawer side rail and a drawer side rail having a top flange which curves around the top of the roller of the drawer guide. The drawer side rail roller cannot be disengaged from the guide rail and the guide rail roller cannot be disengaged from the drawer side rail by lateral force applied to the drawer. Thus a lateral force applied to the installed drawer laterally repositions both drawer guides at the same time.

With respect to the description set forth above, it is to be realized that the optimum dimensional relationships for the parts of the invention to include variations in size, materials, shape, form, function and manner of operation, assembly and use, are deemed readily apparent and obvious to one skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described. All suitable modifications and equivalents that fall within the scope of the appended claims are deemed within the present inventive concept.

What is claimed is:

1. A laterally adjustable mounting bracket for use in a desk or cabinet drawer and with a drawer guide having a tongue portion, the bracket comprising: a base having a tongue portion receiving end and a second end; opposing spring flanges each secured to the base and each having an upstanding side section integrally secured to the base, a flat top section generally parallel to the base and connected to the side section, an inclined section extending downwardly from the top section toward the base, and a lower section generally parallel to the base connected to the inclined section forming a tongue portion opening smaller than the thickness of the tongue portion, the tongue portion openings cooperatively receiving the tongue portion and frictionally maintaining the tongue portion therein for lateral adjustment; and a vertical stop formed on the base limiting the lateral movement of the drawer and carried drawer guide.

2. The bracket as claimed in claim 1 wherein the spring flanges at least partially encircle a portion of the drawer guide tongue portion.

3. The bracket as claimed in claim 2 wherein the drawer guide tongue portion is curved.

4. The bracket as claimed in claim 1 wherein the base has a front and back wall and the base securing means includes fasteners extending from the back wall to engage the desk or cabinet.

5. The bracket as claimed in claim 4 wherein each of the fasteners include a dowel portion and flexible latching members securing the base to the desk or cabinet.

6. The bracket as claimed in claim 5 wherein the latching members have shaft sections and engaging ears to secure the bracket to the desk or cabinet.

7. The bracket as claimed in claim 6 wherein the latching member shaft sections are grooved.

8. The bracket as claimed in claim 7 wherein the drawer guide tongue portion is curved.

9. The bracket as claimed in claim 7 wherein the fastener dowel portions have one or more ribs extending parallel to the axes of the dowel portions.

10. The bracket as claimed in claim 5 wherein the fastener dowel portions have one or more ribs extending parallel to the axes of the dowel portions.

11. The bracket as claimed in claim 4 wherein the drawer guide tongue portion is curved.

12. The bracket as claimed in claim 1 wherein the drawer guide tongue portion is curved.

13. The bracket as claimed in claim 1 wherein the limiting means is a stop carried by the base and positioned at the tongue portion receiving end of the base.

14. The bracket as claimed in claim 1 wherein the limiting means is a fixing screw securing the drawer guide tongue portion to the drawer in a predetermined location.

* * * * *